US007574817B2

(12) United States Patent
Fechter

(10) Patent No.: US 7,574,817 B2
(45) Date of Patent: Aug. 18, 2009

(54) SHOCK ABSORBER SPACING DEVICE

(75) Inventor: Norbert Anton Fechter, Haigerloch-Stetten (DE)

(73) Assignee: FRAMAS Kunststofftechnik GmbH, Pirmasens (DE)

( * ) Notice: Subject to any disclaimer, the term of this patent is extended or adjusted under 35 U.S.C. 154(b) by 380 days.

(21) Appl. No.: 10/572,488

(22) PCT Filed: Sep. 17, 2004

(86) PCT No.: PCT/EP2004/052221

§ 371 (c)(1),
(2), (4) Date: Apr. 5, 2006

(87) PCT Pub. No.: WO2005/025358

PCT Pub. Date: Mar. 24, 2005

(65) Prior Publication Data

US 2006/0254087 A1 Nov. 16, 2006

(30) Foreign Application Priority Data

Sep. 17, 2003 (DE) ..... 103 43 261

(51) Int. Cl.
*A43B 13/28* (2006.01)

(52) U.S. Cl. ..... 36/27; 36/28; 36/37

(58) Field of Classification Search ..... 36/27, 36/28, 35 R, 37, 38; 267/160, 181
See application file for complete search history.

(56) References Cited

U.S. PATENT DOCUMENTS 614,688 A * 11/1898 Barber ..... 36/37
4,535,553 A * 8/1985 Derderian et al. ..... 36/28
4,638,575 A * 1/1987 Illustrato ..... 36/38
4,815,221 A * 3/1989 Diaz ..... 36/27
5,022,168 A 6/1991 Jeppson, III et al.
5,311,674 A * 5/1994 Santiyanont et al. ..... 36/28
5,409,200 A * 4/1995 Zingher et al. ..... 267/160
5,551,673 A * 9/1996 Furusawa et al. ..... 267/160
5,678,327 A 10/1997 Halberstadt
5,785,303 A * 7/1998 Kutschi ..... 267/103
6,516,539 B2 2/2003 Nishiwaki et al.
6,595,503 B1 * 7/2003 Cheng ..... 267/160
2001/0007177 A1 * 7/2001 Brown et al. ..... 36/27
2002/0038522 A1 * 4/2002 Houser et al. ..... 36/28
2004/0134098 A1 * 7/2004 Beck ..... 36/44
2005/0028403 A1 * 2/2005 Swigart et al. ..... 36/28

FOREIGN PATENT DOCUMENTS

DE 37 32 495 A1 9/1988
DE 41 22 557 A1 1/1993
DE 199 55 550 A1 12/2000
GB 431 023 6/1935

* cited by examiner

*Primary Examiner*—Marie Patterson
(74) *Attorney, Agent, or Firm*—Collard & Roe, P.C.

(57) ABSTRACT

The invention relates to a spacing device substantially consisting of flexible structural supporting elements comprising open arches which are arranged near each other and one after another according to a grid pattern above a base plane and openings which are arranged according to a corresponding grid pattern and pass through the base plane at least below the arches.

24 Claims, 11 Drawing Sheets

Figure 1:
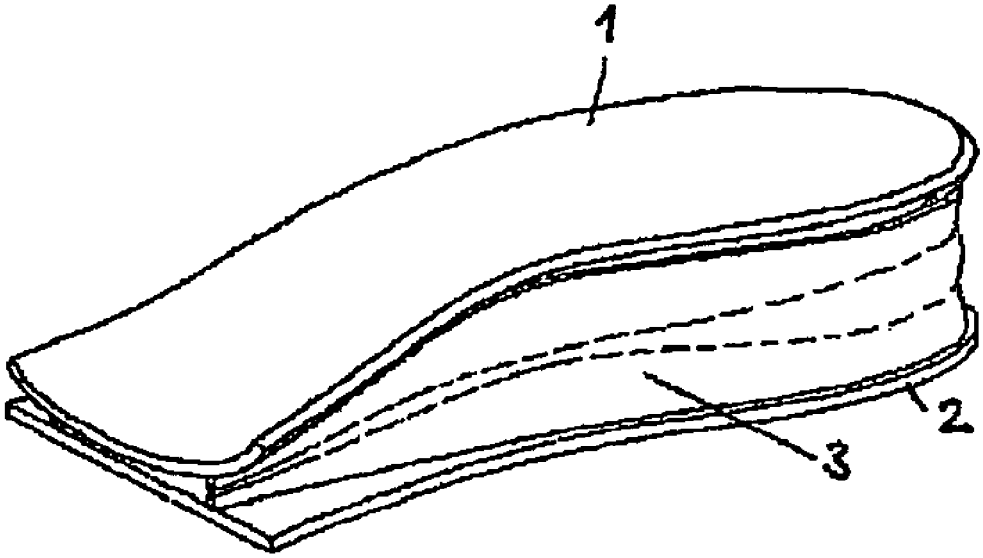

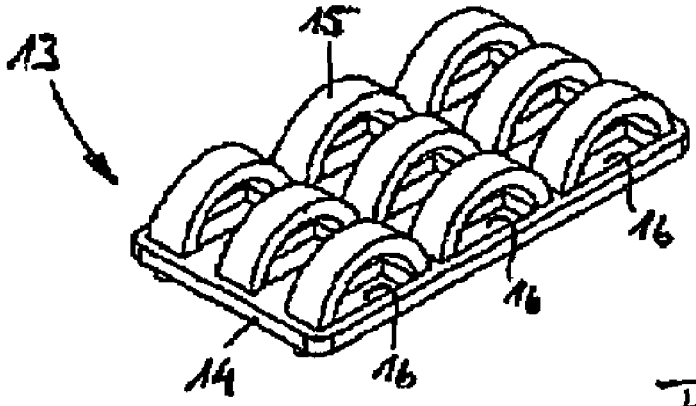
Fig. 6
Fig. 7
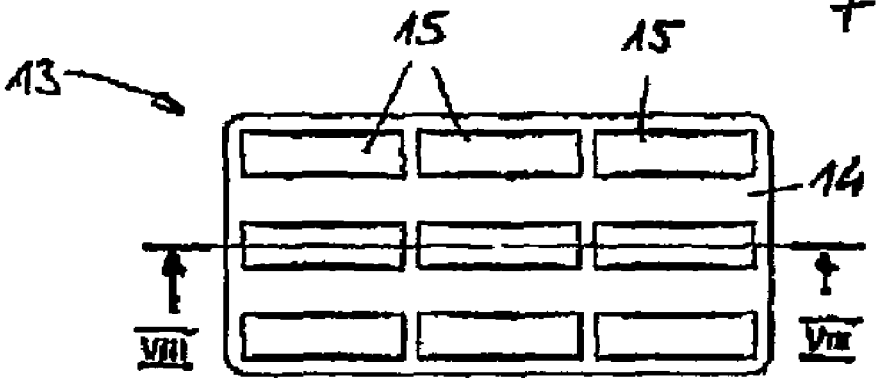
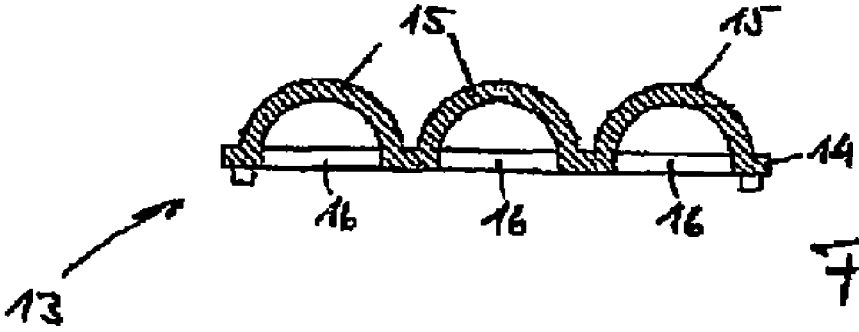
Fig. 8

SHOCK ABSORBER SPACING DEVICE

CROSS REFERENCE TO RELATED APPLICATIONS

Applicants claim priority under 35 U.S.C. §119 of German Application No. 103 43 261.2 filed Sep. 17, 2003. Applicants also claim priority under 35 U.S.C. §365 of PCT/EP2004/052221 filed Sep. 17, 2004. The international application under PCT article 21(2) was not published in English.

The invention relates to a shock-absorbing spacer device suitable for arrangement between surfaces that are spaced apart from one another and are flexible and/or movable relative to one another, for example for arrangement between an inner sole and outer sole of a shoe.

According to U.S. Pat. No. 5,022,168, a middle sole provided between an inner sole and an outer sole of a shoe can consist principally of two relatively stiff fabric layers which are spaced apart from one another and between which fabric webs configured as X-shaped profiles and interwoven with the aforementioned fabric layers are arranged as spacer elements. The fabrics can, for example, comprise polypropylene, polyvinyl or polyester.

DE 37 32 495 A1 discloses an insole with knobs of elastomer material arranged on the underside, it being possible for the knobs in the heel area to have a greater diameter and greater height than those in the toe area. These knobs form flexible spring elements which cushion the foot shell of the insole relative to the outer sole.

U.S. Pat. No. 6,516,539 B2 describes a shock-absorbing shoe sole that consists principally of a bottom sole with a corrugated top face and of a top sole with a corrugated bottom face, the concave zones of the corrugated structure of the bottom sole receiving the convex zones of the corrugated structure of the top sole. By means of different shapes of corrugations and by means of corresponding spacer elements, it is ensured that the corrugated structures load one another mainly at the flanks of the corrugations and are otherwise spaced apart from one another, at least in the unloaded state. This is intended to guarantee that, when a load is placed on the sole, the corrugated structures made of elastomer material are subjected to shear loads in the area of the flanks of the corrugations, thus providing good flexibility.

The object of the invention is now to make available a shock-absorbing spacer device whose absorbing and cushioning properties can be predetermined within an extremely wide range, a further aim being for it to be light in weight and to permit good circulation of air.

According to the invention, this object is achieved by a flexible structural supporting element with open arches arranged alongside one another and/or one after another in a grid pattern above a base surface, and with openings which are arranged in a corresponding grid pattern and which pass through the base surface at least below the arches.

The invention is based on the general concept of arranging deformable supporting arches connected to one another in a grid pattern. Loading of the center of the arch leads to a corresponding deformation of the arch, the side parts of the arch being forced sideward and forming, compared to the height of the unloaded arch, shortened columnar supports with a relatively high load-bearing capacity. In relation to a loaded surface resting on the arches, this permits a noticeably and progressively increasing resistance, i.e. despite initially high flexibility, a high supporting force is possible without excessive deformation.

The invention affords the advantage of being able to be used in a wide variety of ways. First, the spacer device according to the invention can be fitted between the outer sole and inner sole of a shoe. Second, the spacer device can also be used for protectors, e.g. knee protectors or elbow protectors, or for stiffening of deformable or flexible hollow bodies.

According to a preferred embodiment of the invention, the arches are arranged alongside one another in rows of arches running transversely with respect to the arch axis.

This makes it possible for the arches of each row of arches to be offset, by half the span of an arch, relative to the arches of the adjacent row of arches or rows of arches.

Instead of this, it is also possible to arrange the arches of each row of arches on the same axis relative to the arches of the adjacent row of arches or rows of arches.

In the base plane, between the rows of arches, continuous bands can be arranged which run parallel to said rows of arches and which are connected to one another in the transverse direction via the foot zones of the arches arranged in the base plane. In this arrangement, the foot zones of the arches are held in a comparatively stable manner within the base plane.

Instead of this, it is also possible for each foot zone between adjacent arches of a row of arches to be connected via narrow, flexible webs to a foot zone between adjacent arches of the adjacent row of arches or rows of arches. In this way, the foot zones of each row of arches acquire quite considerable flexibility in the longitudinal direction of the row of arches.

If appropriate, however, this flexibility can be eliminated or reduced by a panel element which has a lattice structure with windows arranged in a grid pattern corresponding to the arches of the structural supporting element, the lattice webs being designed with concavities or convexities in or on which the foot zones of the arches of the structural supporting element and/or its webs are held securely by means of a form fit.

In such an arrangement, very different materials can be used for the structural supporting element and the panel element. For example, the panel element can be made of flexible but substantially inextensible material, whereas the structural supporting element can be formed from an elastomer or the like. By means of a composite construction of this kind, it is possible to ensure very different load-bearing capacities depending on orientation.

In principle, it is possible and advantageous to arrange two structural supporting elements with arches facing one another, if an intermediate layer of great strength is to be formed.

According to a particularly preferred embodiment, in each case one of the rows of arches mounted on one another has arches which are comparatively wide in the direction of the arch axes and have windows arranged in the center portions of the arches, which windows receive the center portions of the arches in the opposite row of arches, of which the arches have, in the direction of the arch axes, a width corresponding to the width of the windows.

In this way, the rows of arches of the two structural supporting elements engage in one another with a form fit, such that, between the surfaces spaced apart from one another by the spacer device, surface-parallel forces can also be transmitted, with corresponding deformation of the arches, when the spaced-apart surfaces are connected to the base surfaces of the structural supporting element in a fixed manner or securely against slipping.

According to a modified embodiment of the invention, the arches of a structural supporting element of a spacer device can also be designed as crossover arches, that is to say as a combination of two intersecting arches.

This affords the possibility of the two arch parts of the crossover arch being designed with different thicknesses, so as to obtain resistance characteristics dependent on orientation.

Furthermore, it is possible for two identical structural supporting elements to be combined in such a way that the concave faces of their arches face one another, in which case provision can also be made for the two supporting elements to be connected to one another, for example at their edges. In this way, it is possible to produce spring cushions that are able to be used in a similar way to pressurized air bags.

A further spacer device, for which separate protection is claimed, is characterized in that a structural element is provided which is designed in the manner of a link conveyor.

Each link of this link conveyor can comprise a piping of substantially circular profile and, parallel to this, a C-shaped profile with the opening of the C directed away from the piping, the C-shaped profile of one link receiving or being able to receive the piping of a neighboring link in a form-fit manner.

Such an arrangement is extremely flexible in the event of flexion movements relative to the piping axes, as long as the connections of a link between piping and C-shaped profile do not interact in contact with the edges of the C opening of the next link. An asymmetrical design of the links, in the axial direction of the pipings, can result in the link conveyor having a different shape when its links are forced in one direction or the other by external forces into the respective contact position.

By means of the links being made of elastically flexible material, the link conveyor, even when its links reach an abutment position, can be forced resiliently beyond this abutment position.

If appropriate, links of different hardness can be combined with one another.

Finally, according to a further invention, soft flexible layers or material layers can be provided with a "skeleton" of mutually parallel ridges which in turn are connected in one piece to at least one further ridge running in the transverse direction thereto, all the ridges preferably being in the shape of a flat band and being able to bend in the manner of a leaf spring.

As regards other preferred features of the invention, reference is made to the dependent claims and to the following explanation of the drawing on the basis of which particularly advantageous embodiments are described in more detail.

Protection is claimed not only for feature combinations that are expressly mentioned or presented here, but in principle for any subsidiary combinations of the presented or described features.

Figure 2:
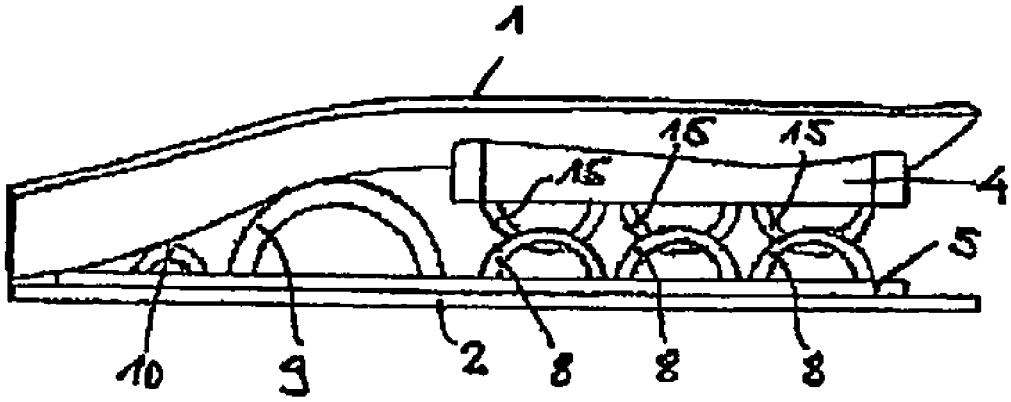
Figure 3:
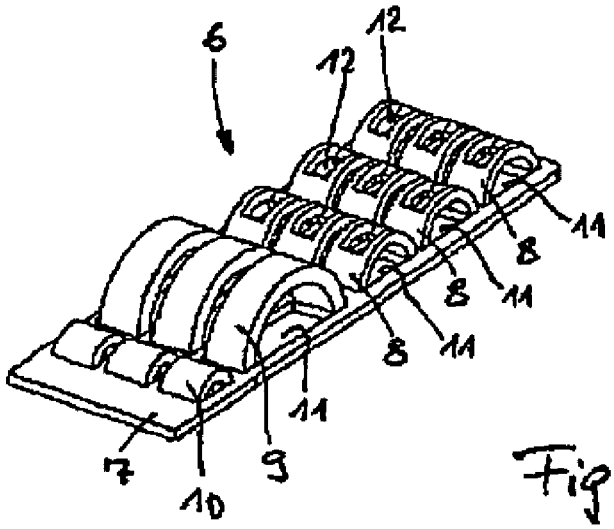
Figure 4:
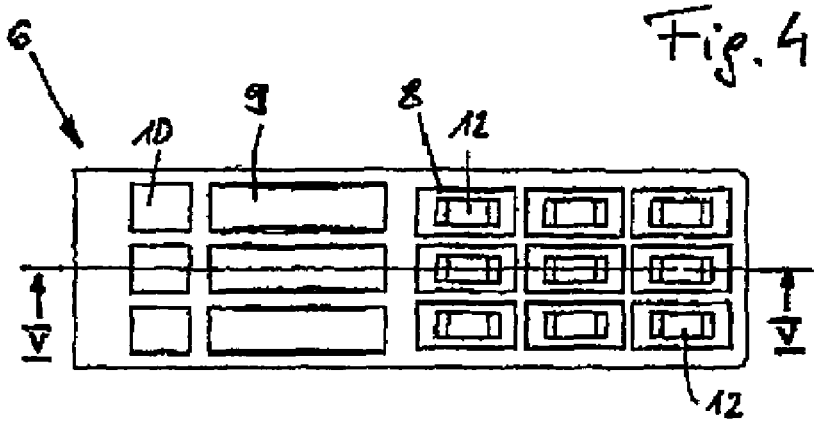
Figure 5:
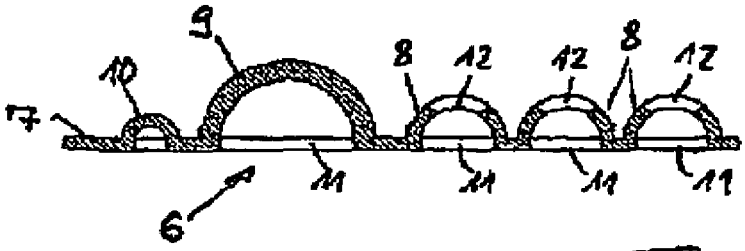
Figure 9:
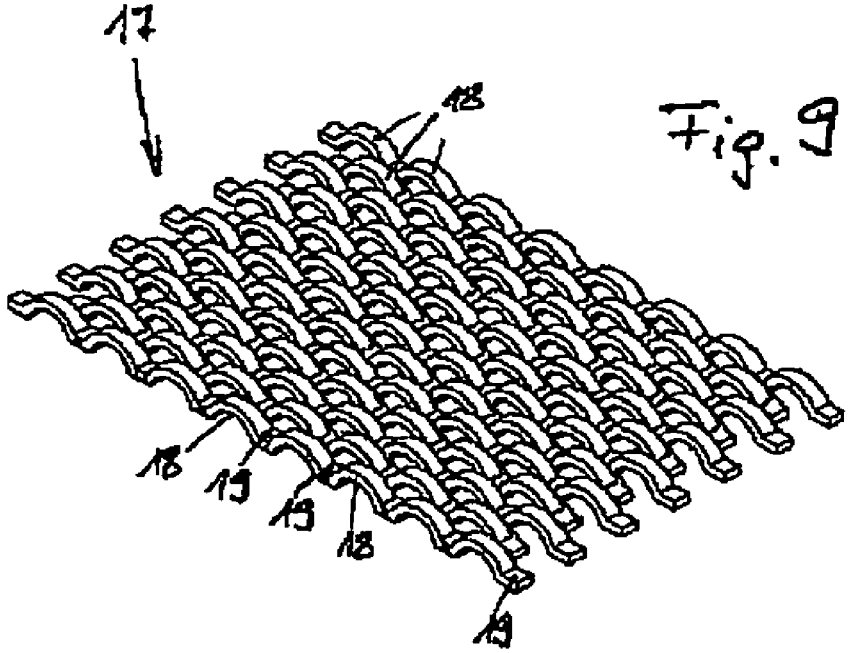
Figure 10:
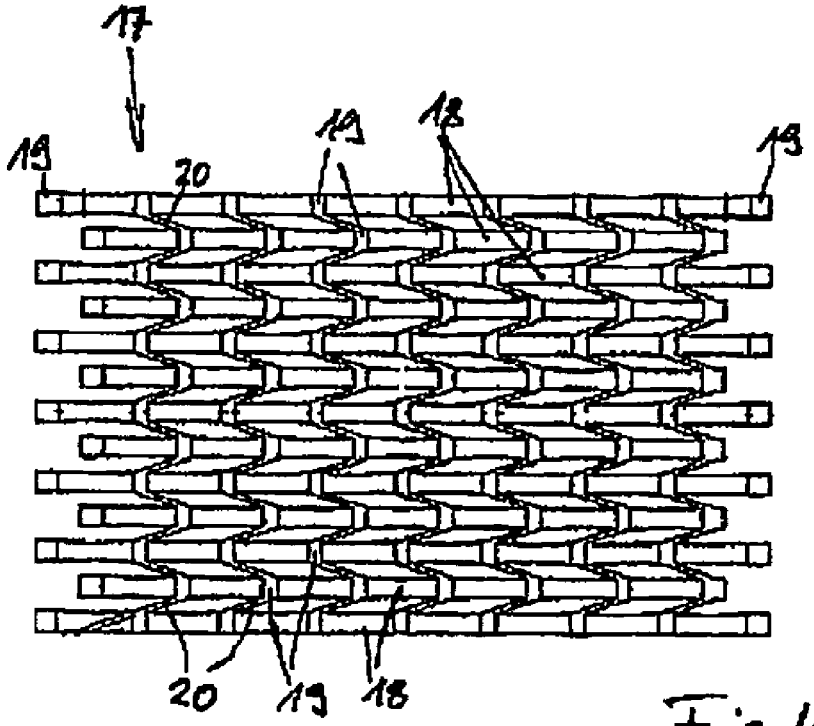
Figure 11:
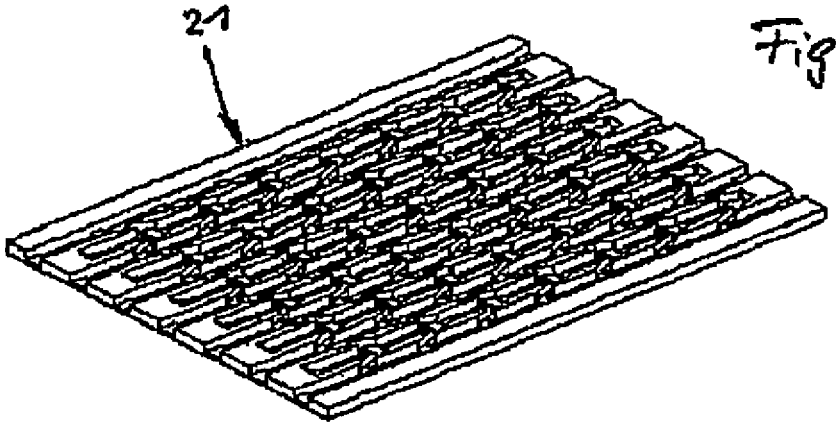
Figure 12:
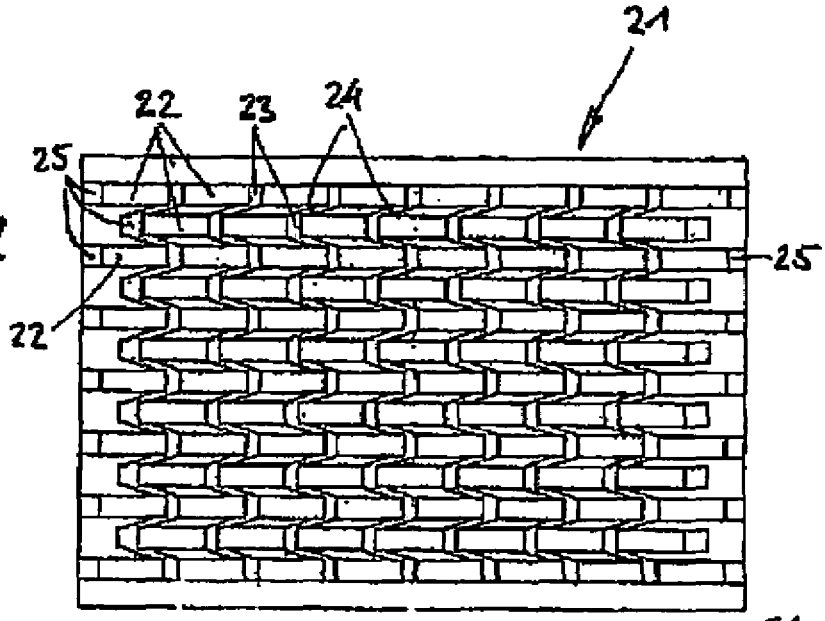
Figure 13:
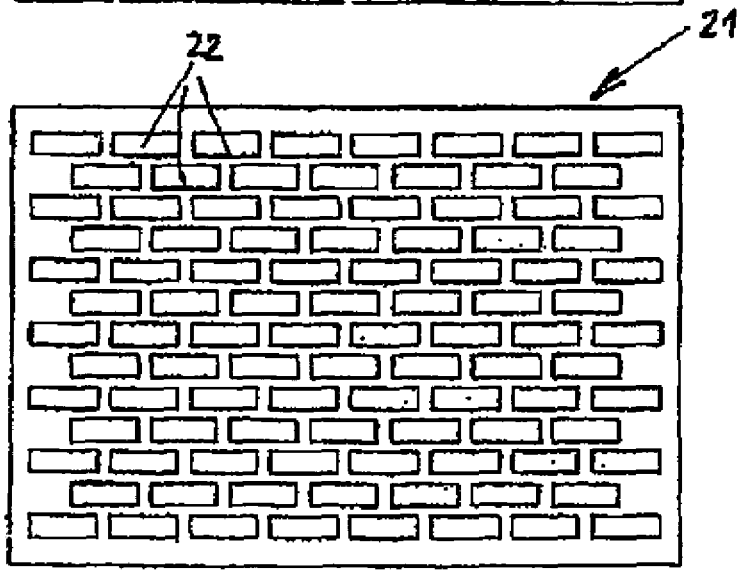
Figure 14:
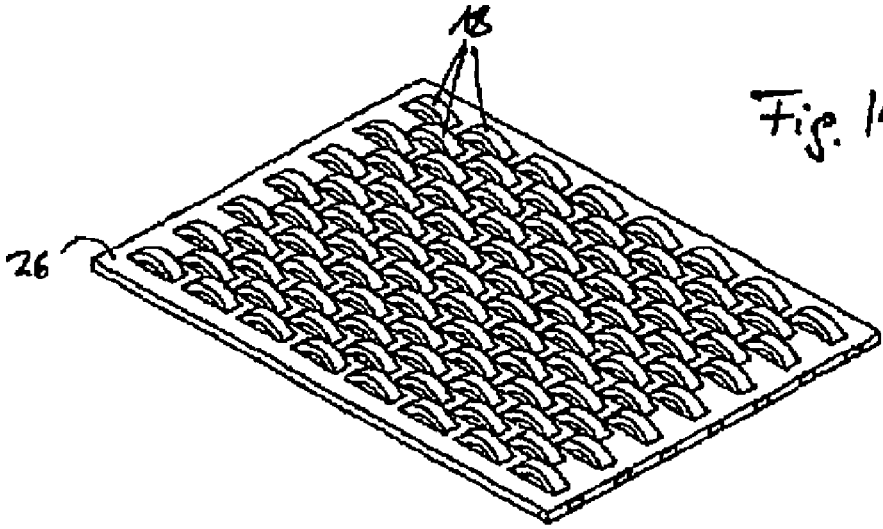
Figure 15:
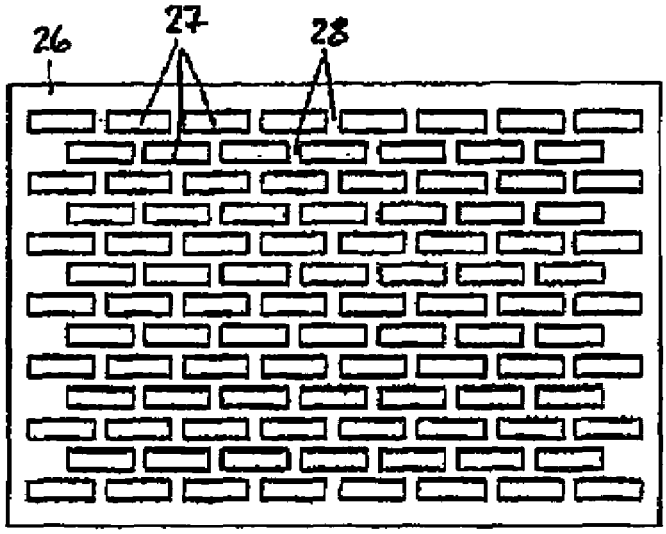
Figure 16:
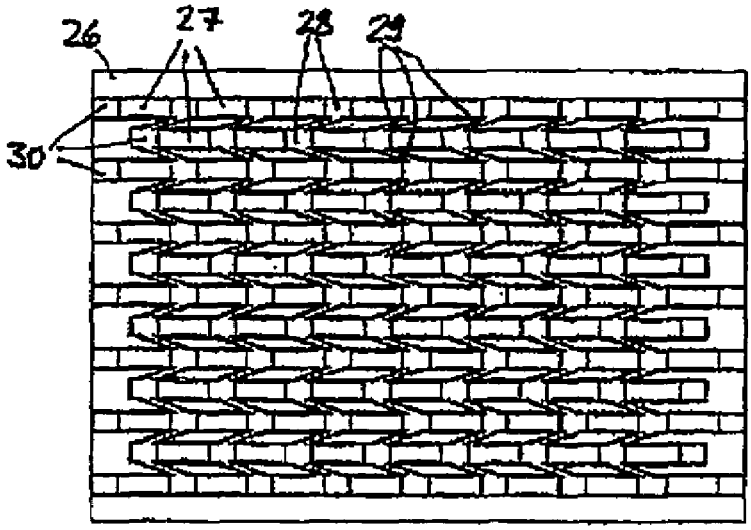
Figure 17:
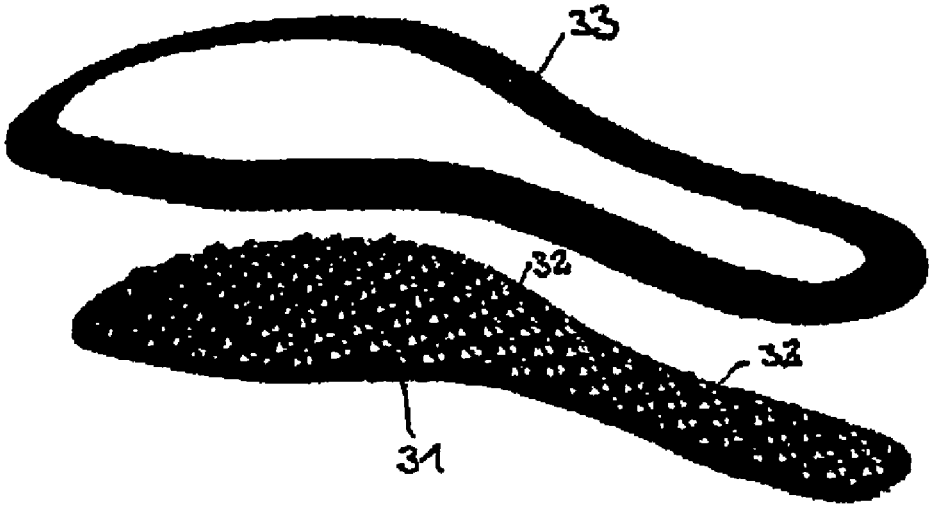
Figure 18:
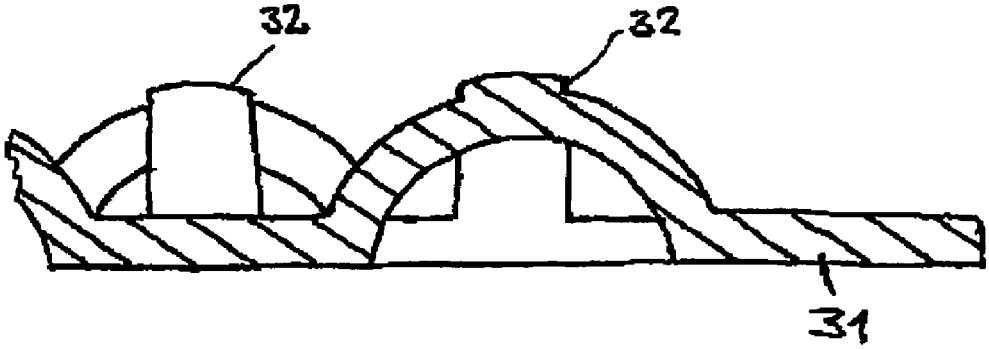
Figure 19:
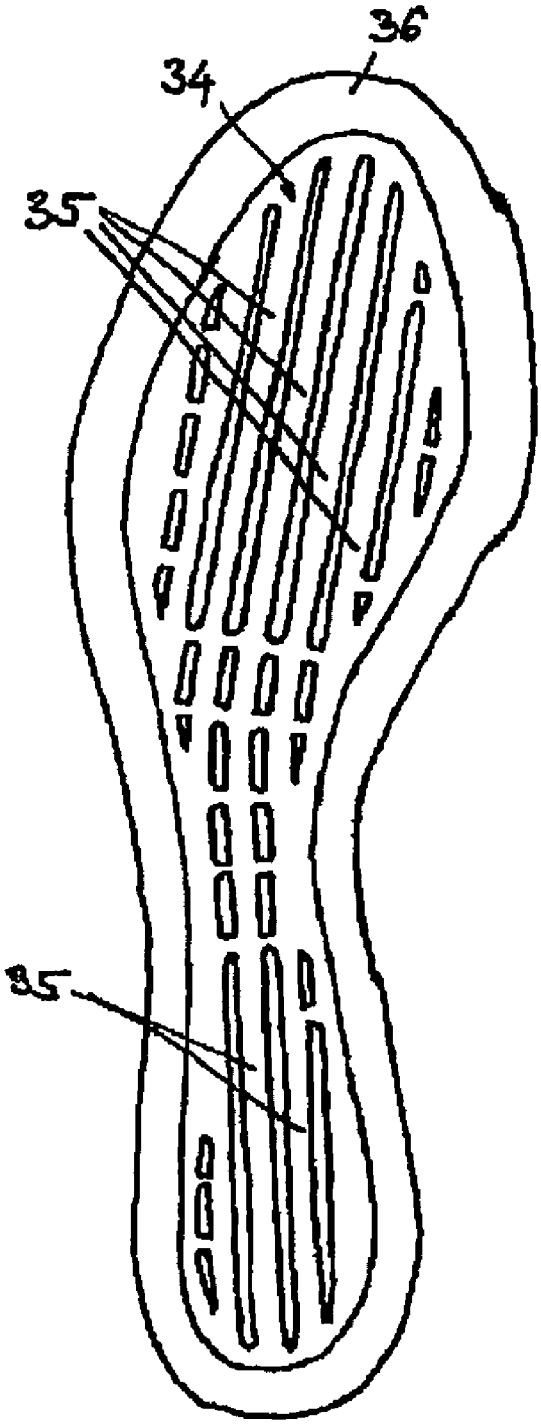
Figure 20:
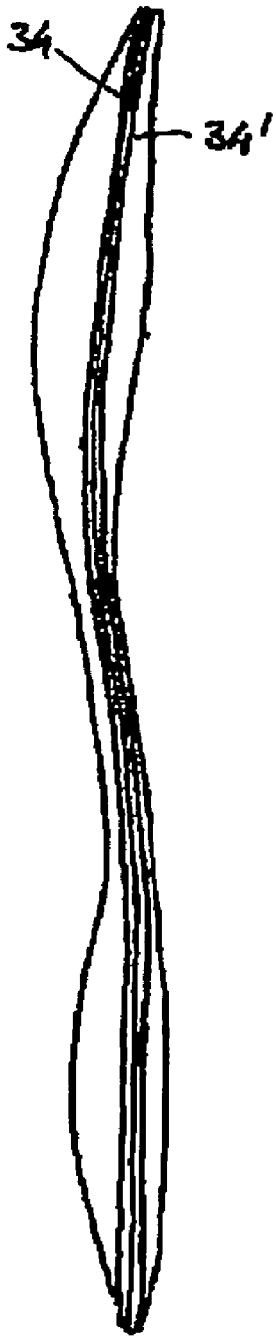
Figures 21, 22:
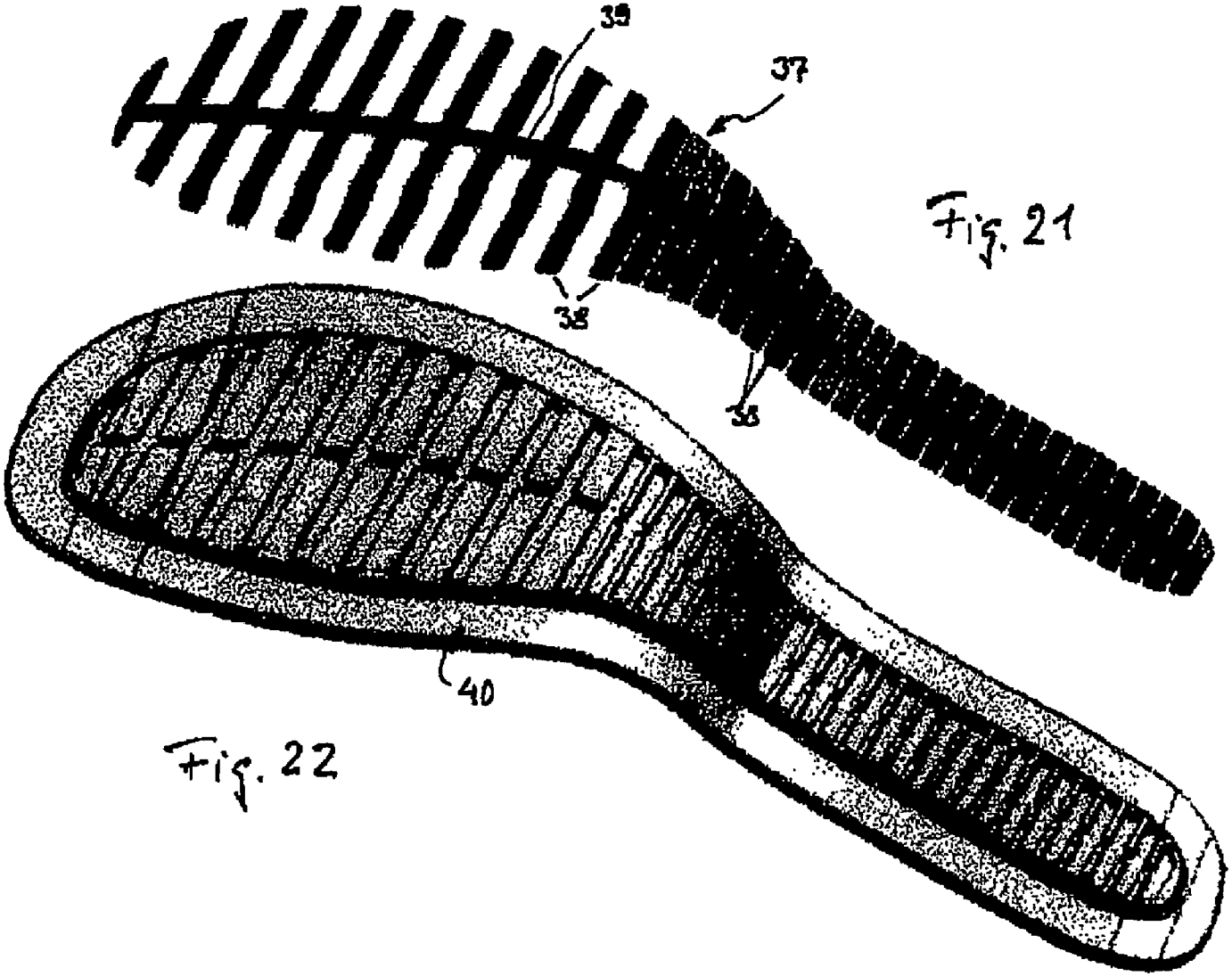
Figure 23:
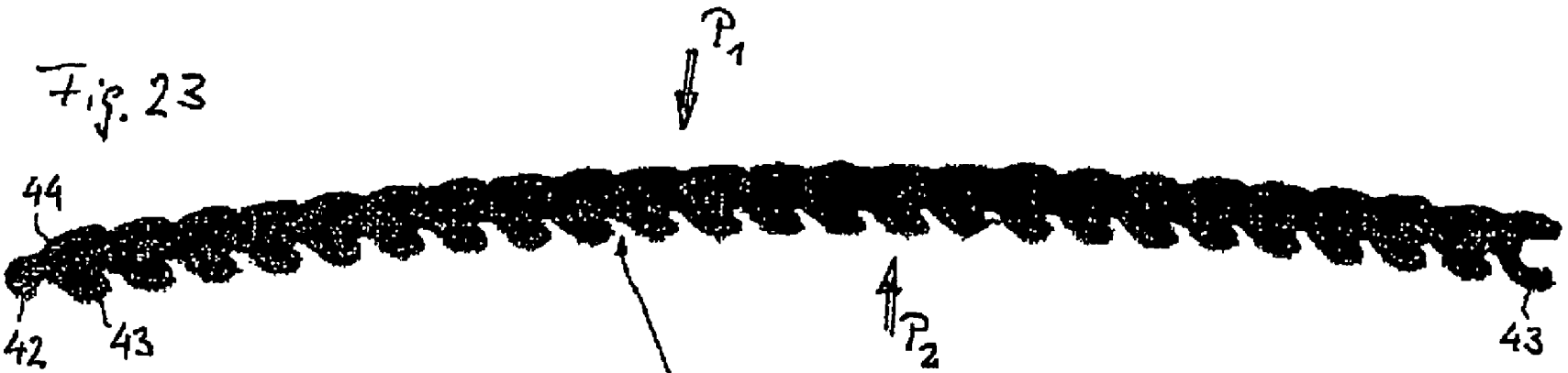
Figure 24:
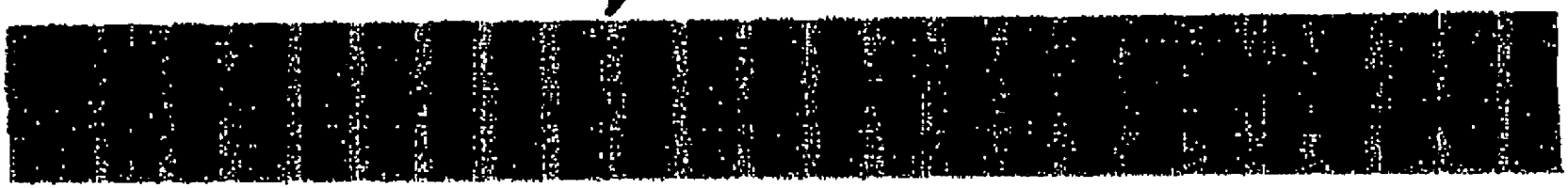
Figure 25:
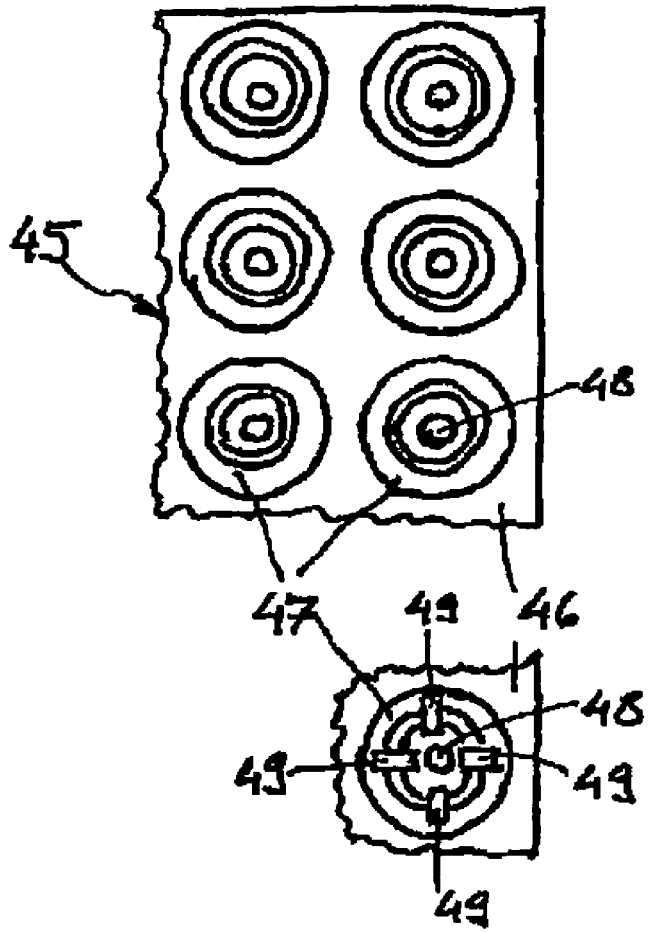
Figure 26:
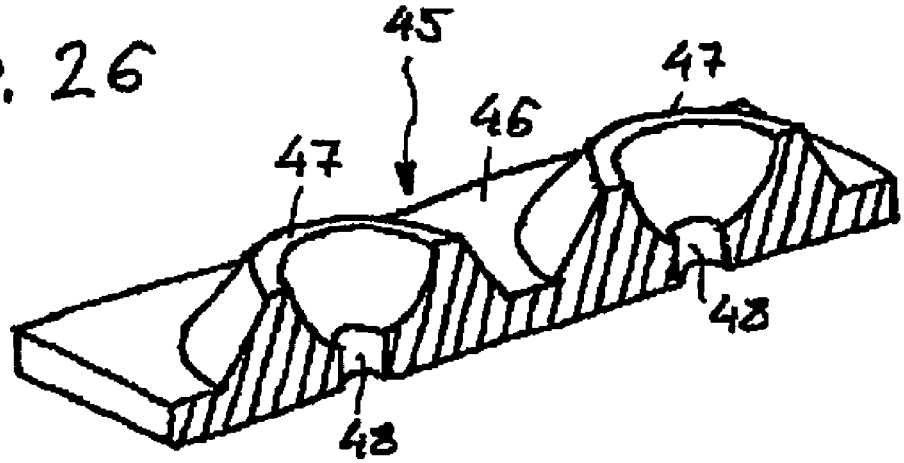

In the drawing:

FIG. 1 shows a perspective view of the heel-side half of a shoe sole arrangement with the spacer device according to the invention arranged between a foot shell or inner sole and an outer sole or outer sole support, FIG. 2 shows a side view of the shoe sole arrangement depicted in FIG. 1, a cover film that encloses the spacer device having been omitted, FIG. 3 shows a perspective view of a structural supporting element arranged on the outer sole or the outer sole support, FIG. 4 shows a plan view of this structural supporting element, FIG. 5 shows a vertical section corresponding to the sectional plane V-V in FIG. 4, FIG. 6 shows a perspective view of a structural supporting element arranged under the foot shell or inner sole, FIG. 7 shows a plan view of this structural supporting element, FIG. 8 shows a vertical section corresponding to the sectional line VIII-VIII in FIG. 7, FIG. 9 shows a perspective view of a further structural supporting element, FIG. 10 shows a plan view of this structural supporting element, FIG. 11 shows a perspective view of a lattice-like panel element that can be disposed under the structural supporting element from FIGS. 9 and 10, FIG. 12 shows a plan view of the top face of this panel element, FIG. 13 shows a plan view of the bottom face of the panel element, FIG. 14 shows a perspective view of a further structural supporting element, with the lattice-like panel element covering its base surface, FIG. 15 shows a plan view of the top face of this panel element, FIG. 16 shows a plan view of the bottom face of the panel element, FIG. 17 shows a further embodiment for a structural supporting element of a spacer device, FIG. 18 shows a sectional detail of the structural supporting element from FIG. 17, FIG. 19 shows a plan view of a further modified structural supporting element, FIG. 20 shows a side view of the structural supporting element from FIG. 19, FIG. 21 shows a structural or skeletal part of a spacer device, FIG. 22 shows a soft part that can be combined with it, FIG. 23 shows a side view of a spacer device designed as link conveyor, FIG. 24 shows a plan view of the spacer device from FIG. 23, FIG. 25 shows a plan view of an absorbing mat, and FIG. 26 shows a perspective sectional view of this absorbing mat.

According to FIGS. 1 and 2, a sports shoe (not shown in detail) comprises, at least within an area of the shoe near the heel, an inner sole 1 in the manner of a foot shell, and an outer sole 2 distinctly spaced vertically apart from it in a zone near the heel, the underside of the outer sole 2 being designed as a tread surface or being covered with a tread surface layer. Arranged between inner sole 1 and outer sole 2 is a spacer device which will be explained in more detail below and which is suitable for shock absorption of considerable compression forces. This spacer device, explained in more detail below, is enclosed by an optionally transparent cover film 3 which is secured to the edges of the inner sole 1 and of the outer sole 2 and determines the maximum spacing of inner sole 1 and outer sole 2. The cover film 3 is flexible in relation to compression forces between the soles 1 and 2.

The inner sole 1 and the outer sole 2 can of course each be made flexible, but with quite considerable stiffness, such that punctiform loads are always carried off across fairly large areas of the respective sole.

A web 4 is formed integrally on the underside of the inner sole 1 and encloses, on the underside of the inner sole 1, a rectangular surface covering the whole heel area.

A similar web 5 is arranged on the top face of the outer sole, but its height is much less than the height of the web 4. In addition, the web 5 has a rectangular U-shape, in a plan view of the top face of the outer sole 2, and the mutually parallel branches of the U extending into the central area of the shoe are connected to one another at the heel end of the outer sole 2 by means of a transverse section of the web 5.

Securely arranged on the surface delimited by the web 5, on the top face of the outer sole 2, there is a first structural supporting element 6 whose edges are bordered by the web 5 and which is shown in more detail in FIGS. 3 to 5.

This structural supporting element 6, which is made of stiffly flexible material, has a base surface 7 which is affixed to the outer sole 2 and on which open arches 8 to 10 are arranged in a grid pattern, below which the base surface 7 is provided with rectangular windows 11, that is to say the aforementioned windows 11 are vaulted by the arches 8 to 10.

In the example shown, the arches 8 to 10 are arranged in three parallel rows of arches, each one consisting of arches arranged alongside one another transversely with respect to the arch axis. In the example in FIGS. 3 to 5, each row of arches comprises three arches 8 of medium span, one arch 9 of large span, and a small arch 10 of low span. All the arches 8 to 10 have the same width in the direction of the arch axis, but the arches 8 are each provided with rectangular windows in the central portion of the arch.

Between the rows of arches, and alongside the two outer rows of arches, the base surface 7 forms bands which run parallel to the rows of arches and which are integrally connected to one another in the transverse direction at the foot areas of the arches 8 to 10, that is to say at the "abutments" of the arches 8 to 10.

According to FIG. 2, the structural supporting element 6 is arranged on the top face of the outer sole 2 in such a way that the arches 8 are arranged nearer to the heel than are the arches 9, and the arches 10 are arranged nearer to the toes than are the arches 9.

Arranged on the surface delimited by the web 4 on the underside of the inner sole 1, there is a further structural supporting element 13, which is shown in more detail in FIGS. 6 to 8. This structural supporting element 13 has a base surface 14 which is delimited by the web 4 and is affixed to the underside of the inner sole 1 and on which identical open arches 15 are arranged alongside one another in three parallel rows of arches, the arches 15 once again vaulting over rectangular windows 16 that extend through the base surface 14. Therefore, between the rows of arches and along the sides of the two outer rows of arches, the base surface 14 forms continuous strip-shaped bands which are integrally connected to one another in the transverse direction at the feet or abutments of the arches.

The further structural supporting element 13 is also made from a tough, stiffly flexible plastic.

In the axial direction, the arches 15 have a width corresponding to the width of the windows 12 in the arches 8 of the first structural supporting element 6 on the outer sole 2.

The inner sole 1 and outer sole 2 and the structural supporting elements 6 and 13 are arranged relative to one another in such a way that the arches 15 of the structural supporting element 13 on the inner sole 1 are received with their central portions by the windows 12 of the arches 8 of the structural supporting element 6 on the outer sole 2, as can be seen from FIG. 2.

The arches 9 of the structural supporting element 6 of the outer sole 2 bear directly, slightly outside the arch center, on the underside of the inner sole 1. The same applies to the arches 10.

When strong compression forces are transmitted between inner sole 1 and outer sole 2 during walking or running, or when the heel area of the shoe touches the ground, the arches 15 of the structural supporting element 13 on the inner sole 1 that are engaged in the windows 12 of the arches 8 of the structural supporting element 6 on the outer sole 2 deform in an ogival shape, in which process the branches of the arches 8 on those edges of the windows 12 parallel to the arch axis are forced slightly sideward. In addition, the arches 15 can shift slightly in the windows 12 with friction.

The arches 9 and 10 are forced slightly sideward by the inner sole acting on them.

By and large, shocks arising when the heel area touches the ground surface are effectively absorbed, although a comparatively firm and hard support of the inner sole 1 relative to the outer sole 2 is provided, that is to say a spongy tread sensation is avoided.

The invention provides a walking sensation similar to that felt when walking barefoot on firm grass, that is to say extreme shock impacts are avoided, even though a firm tread with good gripping of the edge areas of the outer sole 2 on the ground surface is ensured.

The structural supporting element 17 shown in FIGS. 9 and 10 has a large number of parallel rows of arches with identical open arches 18, where adjacent rows of arches in the longitudinal direction are each offset relative to one another by half the span of an arch. In contrast to the above-described structural supporting elements 6 and 13, the structural supporting element 17 has a strongly segmented base surface, for the most part consisting only of small fields 19 which are each arranged between successive arches of a row of arches, and of flexible webs 20 arranged in a herringbone pattern between these fields 19.

By virtue of this design, the structural supporting element 17 is comparatively easily extensible both in the longitudinal direction and in the transverse direction. In the event of tensile forces acting on the structural supporting element 17 in the longitudinal direction of the rows of arches, the span of the arches increases in size as the arch shape flattens. In the event of tensile forces acting transversely with respect to the rows of arches, the herringbone-like webs 20 deform, and adjacent rows of arches attempt to shift relative to one another in the longitudinal direction of the rows of arches.

By virtue of the flexibility in the longitudinal direction and transverse direction, the structural supporting element 17 from FIGS. 9 and 10 can readily be arranged on surfaces extensible in the longitudinal and transverse directions, for example on the underside of extensible insoles, in which case the undersides of the fields 19 and of the webs 20 can be affixed to the facing side of the insole, and the arches 18 on the underside of the insole form a flexible support structure.

If appropriate, the structural supporting element 17 from FIGS. 9 and 10 can be arranged on a panel element 21, as is shown in FIGS. 11 to 13.

This panel element 21 comprises windows 22 arranged in a grid pattern corresponding to the arches of the structural supporting element 17.

As will be seen from FIGS. 11 and 12, the transverse webs 23 between the rows of windows 22 have only a small vertical height compared to the thickness of the panel element 21. In addition, between the transverse webs of adjacent rows of windows, recessed and upwardly open channels 24 are formed that correspond to the pattern of the webs 20 of the structural supporting element 17.

As a result, therefore, vertically thin areas of the panel element 21, provided at the transverse ends of the windows 22, are connected to one another via the channels 24. In this way, the structural supporting element 17 from FIGS. 9 and 10 can be engaged with its underside in a form fit into the recessed areas of the top face of the panel element 21 as shown in FIGS. 11 and 12, the webs 20 of the structural supporting element 17 being received by the channels 24, and the undersides of the fields 19 of the structural supporting element 17 bearing on the vertically thin transverse webs 23 or the correspondingly vertically thin zones 25 at the transverse ends of the rows of windows of the panel element 21.

If the panel element 21 is produced from a flexible but tough and substantially inextensible material, this in the first instance ensures that the structural supporting element 17 connected to the panel element part 21 is stiffened in the longitudinal and transverse directions. Secondly, the panel element 21 forms a loadable platform which, via the grid of arches 18 of the structural supporting element 17 arranged on the panel element 21, can be supported flexibly in relation to an opposite surface.

According to FIGS. 14 to 16, a panel element 26, corresponding in principle to the panel element 21 described above, can also be designed, by suitable dimensioning of the windows 27, transverse webs 28, channels 29 and zones 30, in such a way that in accordance with FIG. 14 it can be laid from above onto the structural supporting element 17 such that the arches 18 of the structural supporting element 17 protrude through the windows 27 of the panel element 26.

In this embodiment too, the structural supporting element 17 is stiffened by the panel element 26 in the longitudinal and transverse directions.

At the same time, the panel element 26 defines a minimum thickness to which the combination of structural supporting element 17 and panel element 26 can be compressed under vertical compression loads.

FIGS. 17 and 18 show a further embodiment of a spacer device which is suitable, for example, as a cushion for an inner sole of a shoe. Rhomboid windows are arranged in a grid pattern in a base panel 31 having the shape of a shoe sole, these windows each being vaulted by crossover arches 32. Each arch of a crossover arch 32 connects two diametrically opposite corners of a rhomboid window. As can be seen in particular from FIG. 18, the arch parts of a crossover arch 32 can have different sizes of cross section, so that in each case a "strong" arch is combined with a comparatively "weak" arch. This means that the crossover arches 32 have a stability dependent on orientation.

Instead of the rhomboid windows, which if appropriate can also have the shape of a square or of a narrow, elongated diamond, it is also possible in principle to provide windows that have another shape, for example a rectangular or parallelogram shape. If, in this case, diametrically opposite corners of the window are connected by the arches of a crossover arch, the arches of one crossover arch pass one another at an angle different than 90°.

The edge of the base panel can be connected to a flat frame 33 which encloses the base panel and continues the plane of the base panel.

The frame 33 on the one hand, and the base panel 31 with the crossover arches 32, are preferably produced from different materials. It is generally preferable for the frame 33 to be made of a harder material, in particular a material that in practice is inextensible, while the base panel 31 and the crossover arches are relatively flexible.

Instead of this, the reverse choice of material may also be advantageous.

A layer of air-permeable material, for example leather, woven fabric and/or nonwoven fabric, can be arranged on the face of the base panel 31 directed away from the crossover arches 32. If the arrangement shown in FIGS. 17 and 18 is used as the inner sole of a shoe, this layer forms the face directed toward the foot.

In the embodiment shown in FIGS. 19 and 20, a base panel 34, adapted in plan view to a shoe sole, has a grid-like design in which grid bars 35 extending substantially in the longitudinal direction of the base panel 34 are formed for example in the shape of flat bands and, particularly in a central portion of the base panel 34, can be joined to integrally connected transverse bars so as to form a mesh-like structure.

In front of and behind this mesh-like structure, the grid bars 35 form more or less pronounced arches, such that, in the plan view in FIG. 19, the concave face of the arches is oriented toward the observer.

As FIG. 20 shows, the base panel 34 can be combined with an identical base panel 34' in which the arches formed by the grid bars are arched in the opposite direction.

If the base panels 34 and 34' are now arranged on one another via their identical contours, and with the concave faces of the arches formed by the grid bars 35 directed toward one another, a gridwork sole is created whose grid bars 35, both in the ball area and in the heel area of the foot, enclose spaces or clearances that are available for shock-absorbing flexion movements of the grid bars.

Generally speaking, spring cushions formed by arch-shaped flexible grid bars are thus created. In the case of a sole, this ensures flexible cushioning of the heel area and/or ball area of the foot.

If appropriate, a flat frame 36 can be arranged at the edge of the base panel 34 and/or of the base panel 34'. This flat frame 36 can, for example, be made of a comparatively soft foam-like material via which the respective base panel 34, 34' is gently supported at its edge in the shoe.

If necessary, the frame 36 can also be made of a relatively hard material if a firm support of the edge of the base panel 34, 34' is desired.

Otherwise, the frame 36 can be covered on its top face and/or bottom face with cushions or the like.

In the embodiment shown in FIGS. 21 and 22, a structural element 37 is provided with parallel ridges 38 in the form of flat bands which are integrally connected to one another by a flat band 39 that extends transversely with respect to the ridges 38. The ridges 38 and the flat band 39 can be made of a fiber-reinforced plastic with relatively great stiffness and resistance to stretching, for example comparable to a spring steel sheet.

As FIG. 21 shows, the ridges 38 can have relatively large spaces between them within a first portion of the flat band 39, and can have comparatively narrow spaces between them within a second portion of the flat band 39.

The structural element 37 is arranged on a layer 40 of soft material or is embedded in the layer 40, the structural element 37 forming a flexible "skeleton" for the layer 40. Depending on the size of the spaces between the ridges 38, and depending on whether the ridges 38 are connected to one another by a single flat band 39 or by a plurality of flat bands, it is possible to obtain a different stiffness and flexibility of the layer 40.

The layer 40 can also be made of leather, a nonwoven and/or woven fabric or of some other air-permeable material, this material being arranged on the face directed toward the foot when the arrangement, as shown in FIGS. 21 and 22, is intended to be used as the inner sole of a shoe.

Such an inner sole can, if appropriate, be arranged on that face of a spacer device according to FIGS. 19 and 20 directed toward the foot, such that the grid bars 35 bear on the ridges 38 on the foot side and the supporting forces of the spring cushions formed by the arched grid bars 35 are transmitted via the ridges 38 to the foot across a large surface area.

FIGS. 23 and 24 show a spacer device which is designed in the manner of a link conveyor 41. Each link comprises a piping 42 and, parallel to this, a C-shaped profile 43 which is open on the side directed away from the piping 42 and has such a shape that it is able to receive the piping 42 of a neighboring link in a form-fit manner. The for example web-like connection 44 between piping 42 and C-shaped profile 43 can be offset relative to a plane containing the longitudinal center axes of piping and C-shaped profile, in such a way that the link conveyor is, if appropriate, able to bulge to differing extents in one direction or another or offers different degrees of resistance to bulging in one direction or the other.

In addition, successive links of the link conveyor 41 can, if appropriate, be made of materials of different hardness or flexibility, so as to provide an additional possibility of varying the flexibility.

By means of the shape of the links of the link conveyor 41, different curvatures are generally predefined in one direction and/or the opposite direction of the link conveyor, in which the links of the link conveyor 41 interact in contact with one another, that is to say the connection 44 between piping 42 and C-shaped profile 43 of one link lies on one or other branch of the C-shaped profile 43 of the adjacent link, such that a continuing change of curvature is possible only with deformation of the links. In the example in FIG. 23, the link conveyor offers relatively great resistance to forces in arrow direction $P_1$, whereas there is great flexibility relative to forces in arrow direction $P_2$ until the links once again interact in contact with one another.

The link conveyors 41 can be arranged inside a shoe sole, on the one hand to ensure that the sole is comparatively highly flexible within a predefined range of curvature and, on the other hand, to achieve pronounced stiffening of the sole as soon as the curvature reaches an extent and a direction in which the links 41 interact in contact with one another.

FIGS. 25 and 26 show an absorbing mat 45. This is made of a soft, elastic and relatively tear-resistant material. Ring-shaped or crater-like elevations 47 are arranged on a base layer 46 of constant thickness, with a ring-shaped and outwardly and downwardly sloping wall enclosing in this case a semispherical concavity, at the deepest point of which it is possible to provide a bore 48 that passes through the base layer 46.

This absorbing mat 45 can be used in a variety of ways.

If the grid-like arrangement of the elevations 47 corresponds to the grid-like arrangement of the crossover arches 32 in FIG. 17, the base panel 31 in FIG. 17 can be mounted with the crossover arches 32 on the elevations 47 of the absorbing mat 45. In this case it may be expedient for the crossover arches 32 in the unloaded state to have a relatively large radius of curvature, such that the crossover arches 32 bear substantially only on the annular crest of the ring-shaped elevations 47.

If appropriate, the annular crest can be traversed by radial slits 49 that are open toward the top. If these slits 49 are arranged according to the angles of intersection of the arch parts of the crossover arches 32 in FIG. 18, a receiving bed corresponding to the crossover arches 32 is created.

In this arrangement, the deformability of the absorbing mat 45 and in particular the deformability of the elevations 47 and the deformability of the crossover arches 32 cooperate when, between the absorbing mat 45 and the base panel 31 supporting the crossover arches 32, forces occur that seek to move the base panel 31 and the absorbing mat 45 closer to one another or seek to shift them parallel to one another.

Moreover, the absorbing mat can be used as the insole, inner sole or outer sole of a shoe. In addition, the absorbing mat 45 is also suitable for the padding of gloves, for example golf gloves or goalkeepers' gloves, in which case the padding can also increase the strength of the hand grip.

The drawing has primarily shown arrangements that can be used to keep the outer sole and inner sole, or parts of the outer sole and of the inner sole, of a shoe spaced apart from one another with a greater or lesser degree of flexibility. However, the use of the arrangements shown is not limited to this intended application. Instead, all of the arrangements are also suitable for formation of protectors, for example knee protectors and/or elbow protectors or the like. In these cases, an inner face oriented toward the body is to be kept spaced apart from an outer face, ensuring a shock-absorbing flexibility between outer face and inner face. Moreover, the illustrated arrangements can also be used for stiffening deformable or flexible hollow bodies, for example surfboards or snowboards.

The invention claimed is:

1. A sole having an inner sole, an outer sole and a spacer device arranged between the inner sole and the outer sole, the spacer device comprising a grid pattern with open arches arranged alongside one another and/or after another above a base plane and with openings which are arranged in a corresponding pattern and which pass through the base plane at least below the arches wherein said spacer device is sandwiched as a spacer between the inner sole and the outer sole;

wherein two structural supporting elements are provided with base planes spaced apart from one another and with rows of arches facing toward one another, each row of arches of one structural supporting element being mounted on an associated row of arches of the other structural supporting element; and wherein the rows of arches are made of harder material than the other rows of arches.

2. The sole as claimed in claim 1, wherein rows of arches are provided that consist of arches arranged alongside one another transversely with respect to the arch axis.

3. The sole as claimed in claim 2, wherein the arches of each row of arches are offset, by half the span of an arch, relative to the arches of the adjacent row of arches.

4. The sole as claimed in claim 2, wherein the arches of each row of arches are arranged on the same axis relative to the arches of the adjacent row of arches.

5. The sole as claimed in claim 1, wherein, in the base plane, between the rows of arches, continuous bands are formed which run parallel to said rows of arches and which are connected to one another in the transverse direction via the foot zones of the arches arranged in the base plane.

6. The sole as claimed in claim 1, wherein, in the base plane, each foot zone between adjacent arches of a row of arches is connected via webs to a foot zone between adjacent arches of the adjacent row of arches.

7. The sole as claimed in claim 1, wherein in each case one of the rows of arches mounted on one another has arches which are comparatively wide in the direction of the arch axes and have windows arranged in the center portions of the arches, which windows receive the center portions of the arches in the other row of arches, of which the arches have, in the direction of the arch axis, a width corresponding to the width of the windows.

8. The sole as claimed in claim 1, wherein the structural supporting element as arranged on the underside of an insole.

9. The sole as claimed in claim 1, wherein the structural supporting element is arranged on the underside of an insole and/or the top face of an outer sole of a shoe.

10. The sole as claimed in claim 1, wherein the arches are designed as crossover arches.

11. The sole as claimed in claim 10, wherein the arches of a crossover arch have different spans and/or different cross sections.

12. The sole as claimed in claim 10, wherein the crossover arches are arranged on a base panel that has rhomboid windows underneath the crossover arches, each arch of a crossover arch connecting diametrically opposite corners of the respective rhomboid window.

13. The sole as claimed in claim 12, wherein the rhomboid windows are offset relative to one another, in such a way as to produce a pattern of strips extending through one another in a rhomboid shape, when the base panel is seen in a plan view.

14. The sole as claimed in claim 1, comprising a pair of support structures whose structural supporting elements are directed toward one another with the concave faces of their arches, the mutually facing arches interacting in the manner of a spring cushion.

15. The sole as claimed in claim 14, wherein the arches span the heel area or ball area of a shoe sole and form a heel or ball cushion.

16. The sole as claimed in claim 1, comprising a structural element which is designed in the manner of a link conveyor and whose links each comprise a piping of substantially circular profile and, parallel to this, a C-shaped profile with the opening of the C directed away from the piping, the C-shaped profile of one link receiving or being able to receive the piping of a neighboring link in a form-fit manner.

17. The sole as claimed in claim 16, wherein the links of the link conveyor have asymmetrical cross sections.

18. The sole as claimed in claim 16, wherein the connection or connections between piping and C-shaped profile of each link is or are arranged outside a plane containing the axes of the piping and of the C-shaped profile.

19. The sole as claimed in claim 1, wherein the links are made of flexible material.

20. The sole as claimed in claim 1, wherein links of different hardness and/or elasticity are combined with one another.

21. The sole as claimed in claim 1, wherein parallel ridges in the shape of flat bands are connected to one another via at least one flat band connected in one piece to the ridges, and wherein the ridges and the flat band are respectively arranged on or in a layer which runs at least partially between the ridges and which is made of a material that is pliable and/or extensible compared to the material of the ridges and of the flat band.

22. The sole as claimed in claim 1, wherein a layer made of soft flexible material is provided on at least one face with ring-shaped elevations arranged in a grid pattern or in the manner of a grid.

23. A sole having an inner sole, an outer sole and a spacer device arranged between the inner sole and the outer sole, the spacer device comprising a grid pattern with open arches arranged alongside one another and/or after another above a base plane and with openings which are arranged in a corresponding pattern and which pass through the base plane at least below the arches wherein said spacer device is sandwiched as a spacer between the inner sole and the outer sole and wherein the base plane of a structural supporting element is arranged or fixed on a separate panel element which in turn is designed in a lattice formation with windows or openings arranged in a grid pattern corresponding to the grid pattern of the arches.

24. The sole as claimed in claim 23, wherein the panel element is made of harder material than the structural supporting element.

* * * * *